United States Patent [19]

Boler

[11] 3,966,859

[45] June 29, 1976

[54] MULTIPLE STAGE LIQUID COOLING ASSEMBLY

[75] Inventor: Leonard J. Boler, Minneapolis, Minn.

[73] Assignee: Cherne Industrial, Inc., Edina, Minn.

[22] Filed: Nov. 21, 1973

[21] Appl. No.: 417,793

[52] U.S. Cl. ..... 261/92; 239/220; 239/224

[51] Int. Cl.[2] ..... B01F 3/04

[58] Field of Search ..... 261/92; 239/219–224

[56] References Cited

UNITED STATES PATENTS

| | | | |
|---|---|---|---|
| 1,233,119 | 7/1917 | Parker | 261/DIG. 11 |
| 1,462,363 | 7/1923 | Christensen | 261/DIG. 11 |
| 1,778,364 | 10/1930 | Lewis | 261/DIG. 11 |
| 1,868,632 | 7/1932 | Edge | 261/116 |
| 2,098,152 | 11/1937 | Kessener | 261/92 |
| 2,591,100 | 4/1952 | Rouse | 261/119 R |
| 3,719,353 | 3/1973 | Cherne et al. | 261/92 |
| 3,856,280 | 12/1974 | Desnick et al. | 261/90 |

FOREIGN PATENTS OR APPLICATIONS

| | | | |
|---|---|---|---|
| 406,192 | 8/1924 | Germany | 261/92 |
| 149,276 | 3/1955 | Sweden | 261/92 |

*Primary Examiner*—Tim R. Miles
*Attorney, Agent, or Firm*—Dorsey, Windhorst, Hannaford, Whitney & Halladay

[57] ABSTRACT

A large scale liquid cooling assembly has two stages for air cooling of hot liquid. Each stage has a plurality of liquid spray units for selective controlled projection of liquid drops in at least one trajectory extending generally perpendicular from its unit and in a common horizontal direction therefrom. The drop sizes, velocities and volume rates of the liquid spraying are adapted to provide a directional wind effect across the unit along the common horizontal direction. The water can be initially cooled in the first stage, and subsequently further cooled in the second stage. At least some of the units of the second stage are adjacent some of the units of the first stage, and create directional wind effects complementary to the directional wind effect of the first stage.

The alignment of the liquid spray units in the two stages can take several different forms. For example, both stages can have a plurality of liquid spray units aligned in a rectangular form, the second stage concentric about the first stage. At least some of the rectangular sides of the stages can be adjacent one another so that when the liquid drops are projected inwardly from both stages the directional wind effects created across the units of the outer, second stage are reinforced by the directional wind effects created across the units of the inner, first stage. In another form, both stages have units aligned in circular forms, the second stage concentric about the first stage. The units can also be formed into a spoke-like alignment with rows of the liquid spray units arranged as diverging spokes. In this form, one of the spokes constitutes the first stage, with an adjacent spoke as the second stage. The spoke-like alignment can also be surrounded by a concentric circular spray unit assembly comprising a plurality of liquid spray units, with the spoke-like alignment as the first stage, and the circular assembly as the second stage.

The liquid cooling assembly has control apparatus for controlling some spray units of the stages independently of at least some of the other units of the stages in response to the direction and speed of the ambient wind conditions. This control apparatus can control the cooling assembly to maximize use of a prevailing wind, by activating only those spray units which provide directional wind effects not in opposition to the direction of an ambient wind of a greater than predetermined speed. The control apparatus can also activate only certain spray units which provide directional wind effects complementary among each other and among adjacent units of other stages to maximize use of an ambient wind of less than a predetermined speed.

19 Claims, 9 Drawing Figures

MULTIPLE STAGE LIQUID COOLING ASSEMBLY

CROSS-REFERENCE TO RELATED APPLICATIONS

Certain features of the liquid cooling units described in the present invention and certain other large scale liquid cooling assemblies are disclosed and claimed in one or more of three co-pending applications: Liquid Cooling Apparatus, Ser. No. 296,777; Modular Liquid Cooling Spray Units, Ser. No. 296,778; and Liquid Cooling Assemblies, Ser. No. 296,779; all filed on Oct. 10, 1972. All of the applications are assigned to the same assignee as is the present invention.

BACKGROUND OF THE INVENTION

This invention pertains to apparatus for the large scale cooling of hot liquids, such as the liquid coolant required for the cooling of thermal electrical generating plants. In situations such as these a large amount of hot liquid must be cooled substantially, before being recycled as a coolant or expelled into another body of water. A number of different devices have previously been used to perform this function, such as large cooling towers, cooling ponds extending over large areas of land, and a variety of aerating devices. Many of these earlier devices are considerably dependent upon ambient wind conditions for efficient operation since the rate of heat transfer into the ambient air can be limited by both the saturation and the heating of the air above the devices by the rising hot water vapor. In such cases the overall efficiency and cooling capability of the devices depend greatly upon an ambient wind above a certain minimum speed to replace the heated moist air with cooler drier air. In addition to the speed parameters, the ambient wind direction can be contrary to the direction for maximum heat transfer efficiency.

The co-pending related Applications as referenced above disclose liquid cooling units each of which inherently develops a directional wind effect across the unit as the heated liquid is being cooled. The units are further disclosed as formed into large scale liquid cooling assemblies in which the individual spray units within the assembly can be controlled independently of one another to take advantage of the ambient wind conditions at any given time. These units and the assemblies of units provide a solution to the above prior art problems of dependence on the ambient wind conditions, in that the units inherently generate the necessary wind effects and can be controlled to take advantage of any ambient wind direction. The present invention constitutes a further development in cooling assemblies using these directional wind units.

SUMMARY OF THE PRESENT INVENTION

The present invention provides a large scale cooling assembly having two stages for air cooling of hot liquid. Each stage has a plurality of liquid spray units for selective controlled projection of liquid drops to provide a directional wind effect across each unit along a common horizontal direction. The first stage of the cooling assembly is aligned and oriented to receive and initially cool the hot liquid by controlled projection of liquid drops into a reservoir portion adjacent the units of the first stage, creating a directional wind effect across the units of the first stage. The second stage, with at least some units adjacent units of the first stage, is aligned and oriented to receive and cool the liquid by the controlled projection of liquid drops into a reservoir portion adjacent the units of the second stage, creating a directional wind effect across the units of the second stage complementary to the directional wind effects across the adjacent units of the first stage.

The inherent creation of the directional wind effects within the units is utilized to make the cooling assembly substantially independent of the ambient wind conditions, particularly in the case of an ambient wind speed which is inadequate for sufficient replacement of the air above the assembly, a low-wind condition. In the case of an otherwise adequate ambient wind, a high-wind condition, the directional wind effects generated within the units are utilized to increase the efficiencies of the assembly as discussed below.

A control means for controlling at least some of the spray units of the stages can be included in the large scale liquid cooling assembly. This control means responds to the direction and speed of the ambient wind. In the case of low ambient wind, the control means can select projections of liquid drops to maximize the inherently created directional wind effects. In the case of a high ambient wind, the control means can select projections of liquid drops which provide a directional wind effect not in composition to the direction of the ambient wind, reinforcing the wind surrounding the units.

The two stages can have their liquid spray units aligned in several different configurations. For example, the first stage can have a plurality of liquid spray units aligned in a rectangular form, with the second stage having its units also in a rectangular form substantially encompassing the first stage. By projecting the liquid drops along horizontal directions toward the center of the assembly, directional wind effects are created toward the center of the assembly. At those places in the assembly where units of the two stages are adjacent, the directional wind effects created by the units of the first stage are collinear with and reinforce the wind effects created by the units of the second stage. In this sense, the directional wind effects of the two stages are complementary. In the case of a low ambient wind, the wind effects generated by the units toward the center of the assembly combine at the center of the assembly in a chimney effect to cause the warm air to rise rapidly at that point, drawing in cooler, drier air around the outer portions of the assembly. In the case of a high ambient wind, the control means can control the units so that only those projections of liquid drops which provide a directional wind effect not in opposition to the direction of the ambient wind are activated. In much a similar fasion both stages can take the form of concentric circular spray assemblies, one stage substantially encompassing the other stage with at least some units of one stage adjacent units of the other stage.

As a further example, the liquid cooling assembly can take the form of a plurality of liquid spray units aligned in a spoke-like spray assembly comprising a plurality of rows of liquid cooling spray units arranged as diverging spokes extending radially in a plurality of different horizontal directions from a common central point. Each spoke has a plurality of spray units adapted for selective controlled projection of liquid drops in trajectories extending generally perpendicular and in a common horizontal direction therefrom, providing directional wind effects across the spoke along the common horizontal direction. The first stage of the assembly is formed by the liquid spray units arranged as one of the diverging spokes. The second stage is similarly comprised of another of the diverging spokes with at least some spray units of the second stage adjacent units of the first stage. In the case of a low ambient wind, for example, the spokes of the first and second stages create directional wind effects horizontal across each respective spoke. At these places in the assembly where units of the two stages are adjacent, the directional wind effects created by units of the first stage contain directional comparts collinear with and reinforcing the directional wind effects created by units of the second stage. The common circumferential components of these wind effects form a circular spray pattern about the common central point by which the heated wind resulting from the evaporative cooling of the projected liquid drops is forced vertically upward in a whirling motion. The remainder of the spokes in the assembly aid in this action.

As a modification of the spoke-like cooling assembly discussed above, the spoke-like assembly can form one stage of the overall liquid cooling assembly. The second stage can take the form of a concentric circular spray assembly containing a plurality of liquid spray units arranged to substantially encircle the spoke-like first stage with at least some units of the second stage adjacent units of the first stage. The units of the second stage project the liquid drops in horizontal directions toward the common central point of the first stage, creating directional wind effects toward that common central point. These wind effects aid in the creation of the circular wind effect created by the spoke-like first stage and in that sense are complementary to the directional wind effects across the adjacent units of the first stage.

In both examples using a spoke-like assembly, a control means can be included for controlling at least some of the spray units of the stages. In the case of a low ambient wind, the control means can activate those spray units which create the circular wind effect. In the case of a high ambient wind, the control means can activate those spray units which provide a directional wind effect not in opposition to the ambient wind, reinforcing the wind surrounding the units. The control means can operate in a manner similar to prior art control means as disclosed in the Williams patent, U.S. Pat. No. 2,052,333, issued Aug. 25, 1936, and the Colt patent, U.S. Pat. No. 2,923,861, issued Feb. 2, 1960.

Additional features and advantanges of the invention will be apparent from the following description, in which the preferred embodiments of the invention are shown in greater detail.

BRIEF DESCRIPTION OF THE DRAWINGS

In the drawings which form a part of this application and in which like reference characters indicate like parts.

DESCRIPTION OF THE PREFERRED EMBODIMENTS

Figure 1:
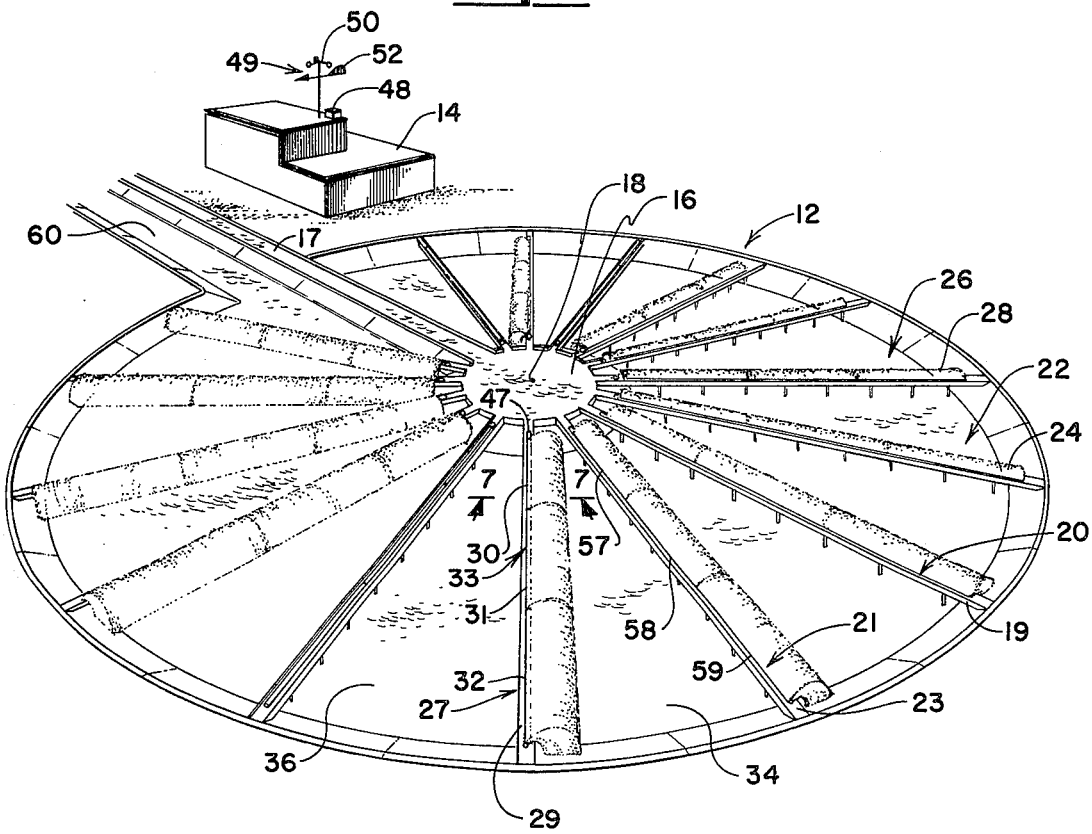
FIG. 1 is a perspective view of a spoke-like liquid cooling spray assembly according to the invention.

As shown in the embodiment of FIG. 1, a large scale liquid cooling assembly 12 is used for large scale cooling of hot liquids such as are produced in the operation of a thermal electrical generating plant 14. The assembly 12 receives the liquid to be cooled via an inner reservoir portion 16 connecting the plant 14 and the cooling assembly 12, the reservoir portion 16 receiving the hot liquid from the plant and carrying it along an input channel 17 to a central point 18 of the assembly. The hot liquid is further distributed in the assembly along spoke-like channels arranged as diverging spokes extending radially in a plurality of different horizontal directions from the common central point 18. Each spoke includes a channel, for carrying the liquid along the spoke, such as channel 19 in spoke 20 extending in longitudinal alignment with the input channel 17. Spokes 21 and 22 have channels 23 and 24, respectively, extending at angles from spoke 20. Several other spokes with channels, such as spokes 26 and 27 with channels 28 and 29, respectively, may be present.

Each of the spokes in the liquid cooling assembly 12 has a plurality of liquid spray units arranged in a row along the spoke, such as spoke 27 with liquid spray units 30, 31 and 32, arranged in a row 33 along the spoke 27. As seen in the FIG. 7 detail of the operation of spray unit 30, each spray unit is adapted for selective controlled projection of liquid drops into either a first trajectory into a first reservoir portion 34 adjacent the unit 30 on one side of the unit, or into a second trajectory into a second reservoir portion 36 adjacent the unit 30 on the other side of the unit. Each trajectory substantially extends generally perpendicular from its spoke and in a common horizontal direction therefrom with drop sizes, velocities and volume rates of liquid spraying adapted to provide a directional wind effect across the spoke along the common horizontal direction. In this manner a directional wind effect can be selectively generated in either generally perpendicular direction from the spoke.

Figure 7:
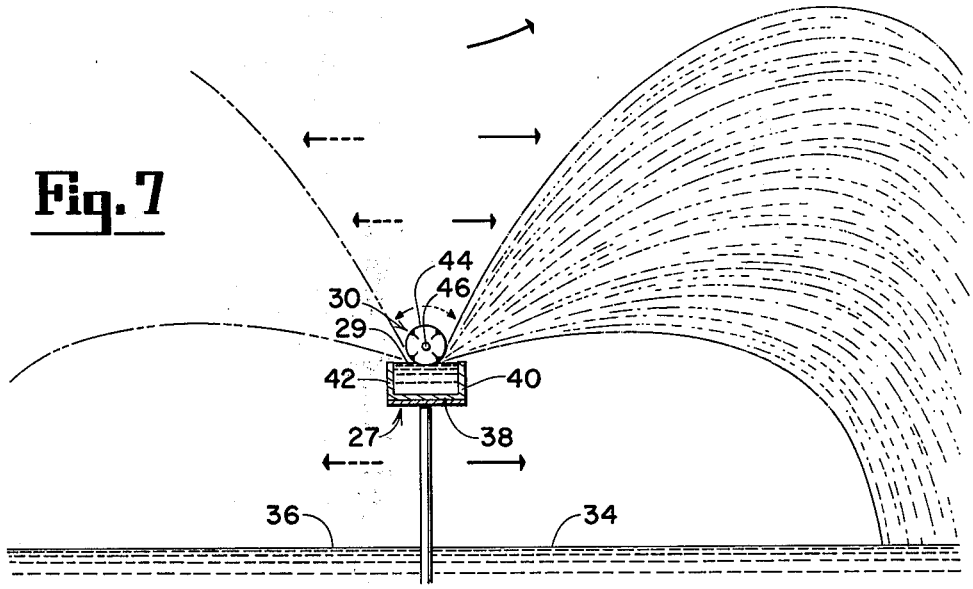
FIG. 7 is a sectional view taken along the line 7—7 of a spoke in FIG. 1.

With reference to the spoke 27 illustrated in FIG. 7, the hot liquid to be cooled is present in the channel 29 formed by a base portion 38, and two side wall portions 40 and 42. The channel 29 of spoke 27, as in all spokes, connects to the inner reservoir portion 16 supplying the hot liquid to the channels. The channel 29 is at a level above the level of the liquid in reservoir portions 34 and 36 to maintain separation between the hot liquid in the spoke 27 and the cooler liquid in the reservoir portions 34 and 36, and to ensure proper operation of the spray units 30 – 32. The particular operation of various types of liquid spray units such as units 30 – 32 are the subject matter of the prior Applications referenced above. Generally, each spray unit of the type illustrated includes a plurality of rotary disc-like spray members 44 all of which are mounted for rotation on a common longitudinal axis at 46 extending along the spoke 27. Each unit is powered for rotation in either direction by a reversible electric motor 47. Each rotary spray member is supplied with liquid at an appropriate limited area of its surface by contact with the liquid in the channel 29. Each spray member projects the liquid drops in either the first or second trajectory by rotation of the member. As viewed in FIG. 7, rotation of each spray member 44 in a counterclockwise direction projects the liquid drops into the first trajectory into the first reservoir portion 34. Similarly, rotation of each member in a clockwise direction projects the liquid drops into the second trajectory into the second reservoir portion 36.

The spray members 44 shown in the preferred embodiment project the liquid in a plurality of trajectories as shown, with each trajectory having a horizontal component extending generally perpendicular from the spoke in accord with the direction of the spraying. For example, projection of the liquid drops into the first reservoir portion 34 results in horizontal trajectory components horizontally to the right in FIG. 2. By projecting the hot liquid drops in a particular manner, a directional wind effect is generated across the spoke along the common horizontal direction. Particularly, by projecting the liquid with drop sizes of at least one millimeter, and by rotating the spray members 44 at peripheral speeds sufficient to project the drops at initial tangential velocities in the range of 15 – 45 feet per second, and by spacing the individual spray members along the axis 46 at intervals sufficiently close so that the liquid drops are sprayed horizontally to the right at a collective volume rate corresponding to at least two pounds of water per second for each lineal foot measured along the axis 46 between the endmost spray members of each individual spray unit, the directional wind effect is developed to the right of the unit 30. While the illustrated unit 30 has been described in detail, other forms of units are capable of developing the desired directional wind effect and can be used in connection with FIGS. 1 – 9 of this application.

The spray units, such as unit 30, which create a directional wind effect are aligned in a variety of configurations in the present invention to better utilize the wind effects developed by different units, particularly to develop a complementary relationship between the wind effects developed by different units. In general, the configurations take the form of two stages, each stage having a plurality of the liquid spray units such as unit 30 to develop directional wind effects across the units. The first stage initially cools the hot liquid. The second stage has at least some units adjacent units of the first stage and also cools the liquid. The second stage is generally adapted to further cool the liquid initially cooled by the first stage, although both stages can be adapted to simultaneously initially cool the hot liquid. Control means can also be included to measure the ambient wind and control the units in accordance therewith.

Figure 5:
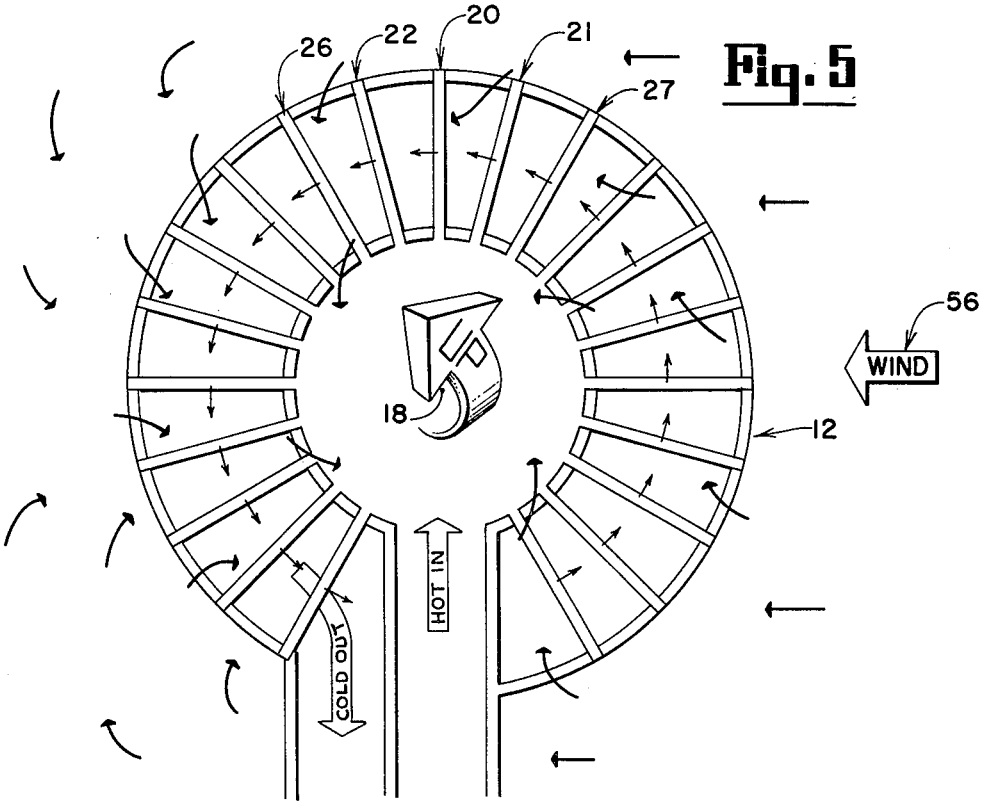
FIG. 5 is a plan view of the assembly of FIG. 1 in a low-wind condition.

In the embodiment shown in the assembly 12 of FIG. 1, each spray unit such as units 30 – 32 can be controlled to project liquid drops to either side of the unit as discussed above, or can be shut off entirely to project no drops. A control unit 48 is included for controlling the spray units of at least some rows independently of the spray units of other rows including selection of one of the first and second trajectory projections for units of at least some rows. For example, the control means can control the spray units of all the spokes to project liquid drops in trajectories with common horizontal circumferential directions from each spoke as shown in FIG. 5. Or only some of the units on some of the rows may be activated as shown in FIG. 1. The selection of which rows, units, and trajectories to activate is generally based upon maximizing the use of the directional wind effects generated by the units vis a vis the speed and direction of the ambient wind, in order to obtain maximum cooling capacity for the system. To this end a control assembly 49 contains the control unit 48, a wind-speed measuring device such as a wind-speed transmitter 50 and a wind-direction measuring device such as a wind-direction transmitter 52.

The wind-speed transmitter 50 and the wind-direction transmitter 52 are conventional devices which generate signals indicative of their respective parameters. The control unit 48 receives the wind-speed and wind-direction information from the transmitters 50 and 52 and activates certain units of the assembly 12 in response thereto. In the preferred embodiments, the control unit 48 is generally programmed to respond to an ambient wind condition of a greater than predetermined speed, termed a "high-wind condition", by activating only those spray units which provide a directional wind effect not in opposition to the direction of the ambient wind. For wind speeds below the predetermined speed cutoff level, termed a "low-wind condition", the control unit 48 activates units under different criteria as discussed below.

Figure 6:
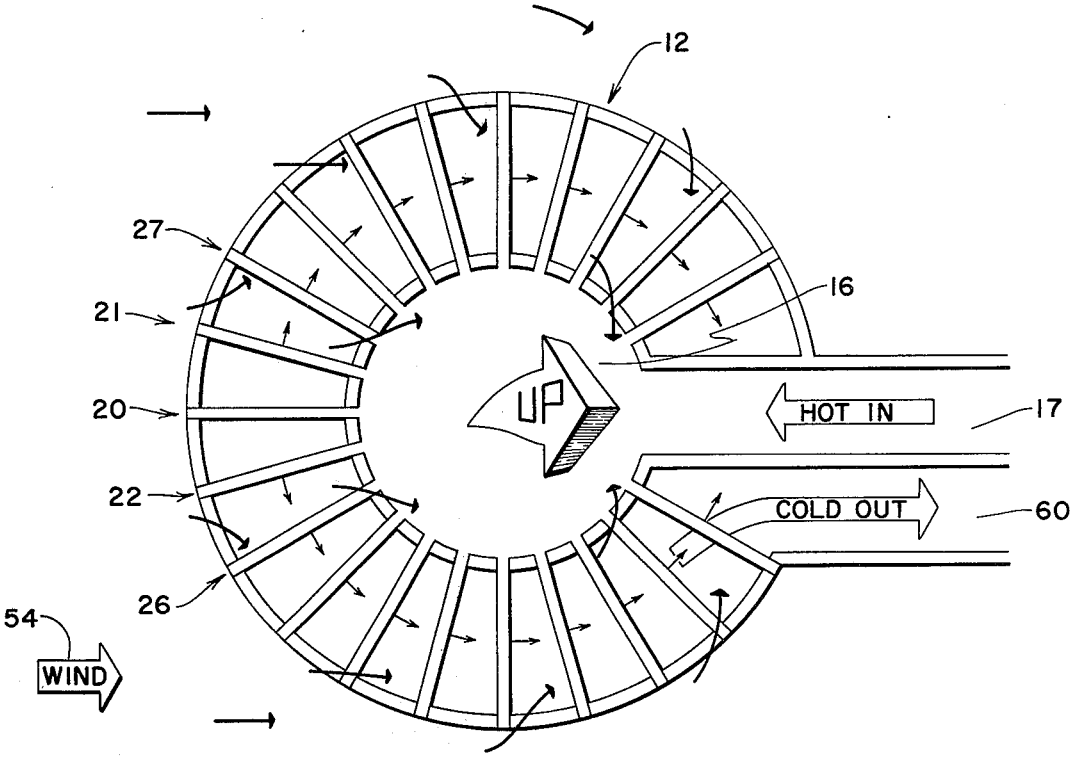
FIG. 6 is a plan view of the assembly of FIG. 1 in a high-wind condition.

The spoke-like assembly 12 is illustrated in FIG. 6 in a high-wind condition. The overall direction of the wind at various points with regard to the assembly 12 are illustrated by the larger, dark arrows. The prevailing ambient wind in the situation illustrated is toward the right of the drawing, along the line of the spoke 20 and the input channel 17, as shown by arrow 54, at a speed greater than the predetermined speed cutoff level. In this situation all the units in all the spokes will be activated to project drops providing a directional wind effect not in opposition to the ambient wind, as shown by the smaller, lighter arrows. Specifically, no units in the spokes will be activated to project drops providing an overall directional wind effect with components toward the left of the drawing, in opposition to the direction of the ambient wind. All units in every spoke except spoke 20 will be activated to project drops providing an overall directional wind effect with components collinear with the direction of the ambient wind, i.e. to the right of the drawing. The units in spoke 20 may project drops providing an overall directional wind effect to either side of the spoke, since either directional wind effect would be perpendicular to the ambient wind and not opposing it.

As shown in FIG. 6, all spokes project hot liquid obtained from inner reservoir portion 16. As the liquid is sprayed by the units in the spokes, heat from the liquid is released, heating the adjacent air. In addition to the heating of the adjacent air, the directional wind effects produced by the spray units result in some deviation of the ambient wind, as illustrated by the dark arrows on the drawing illustrating the resulting winds at various points above the assembly 12. The total overall effect on the resulting winds is the creation of a stronger surrounding wind, resulting in a more efficient transfer of heat from the water to the air than would otherwise be the case. In addition, the combination of the ambient wind with the wind effects created by the spray units results in the surrounding wind forming into a chimney effect above the inner reservoir portion 16, wherein the warm moist air tends to rise quickly above the assembly, removing the warm moist air and drawing in the cooler, drier air to result in more efficient heat transfer from the liquid to the air.

In another high-wind case with the wind blowing in a different direction than that illustrated in FIG. 6, the control unit 48 would again activate the spray units in the spokes to produce wind effects not in opposition to the ambient wind. For example, if the high-condition ambient wind in the assembly 12 of FIG. 6 were blowing in the direction along spoke 27, the spokes between spoke 27 and the input channel 17, in a clockwise direction, would continue to project drops creating wind effects with components collinear with the ambient wind direction, as illustrated in FIG. 6. Spokes 20 and 21, however, would be reversed to project drops creating wind effects in the opposite direction from that illustrated in FIG. 6, with the remainder of the spokes continuing to project drops creating wind effects as illustrated.

In the case of a low-wind condition the control unit 48 activates the spray units to project liquid drops in trajectories with common horizontal circumferential directions from each spoke, forming a circular spray pattern about the common central point 18. This circular spray pattern generally induces a circular wind effect about the common central point 18 by which heated air resulting from the evaporative cooling of the projected liquid drops is forced vertically upward in a whirling motion. This situation is illustrated in FIG. 5, with arrow 56 indicating the direction of the low ambient wind, if any. All units of all spokes are activated to project liquid drops generating the wind effects in the same direction about the central point 18. In the example of FIG. 5, the wind effects are generated in a counterclockwise direction as viewed in the Figure. These wind effects combine with and reinforce one another to form a circular wind effect about the central point 18 wherein the warm moist air is caused to quickly rise above the assembly 12, removing the warm moist air and drawing in the cooler drier air to result in more efficient heat transfer.

In both the high and the low wind conditions, as illustrated in FIGS. 5 and 6, directional wind effects generated by at least some units of different spokes are complementary to one another. That is, the wind effects combine to produce an overall wind effect beneficial to the cooling of the hot liquid. This combining of wind effects of two parts of a system is common among the various configurations of this invention. Specifically, each assembly has at least two stages for the air cooling of a hot liquid. With particular reference to the assembly 12 described with regard to FIGS. 1, 5 and 6, any of the spokes can be termed the first stage, with spoke 21 so designated for purposes of this discussion. The first stage, spoke 21, has three units 57–59, all of which can generate directional wind effects across and to either side of each unit. Similarly, the second stage, spoke 27 for this discussion, also has three units 30–32 which can generate directional wind effects across and to each side of each unit. The units of the stages are adjacent one another to the extent that wind effects generated by units of one of the stages in the direction of the other stage carries to that other stage and influences its overall surrounding wind. In both the examples of the high and low wind conditions illustrated in FIGS. 5 and 6, the wind effects generated by at least some of the units of the first stage 21 carry to the units of the second stage 27, reinforcing the wind effects generated by the units of the second stage 27. Since the wind effects of the first stage reinforce those of the second stage, the wind effects are complementary.

The hot liquid from each unit is projected into its first or second reservoir portions, such as reservoir portions 34 and 36, adjacent the unit on each side. All of these reservoir portions are interconnected with each other and with an outlet channel 60 by which the cooled water is removed from the assembly.

Figure 9:
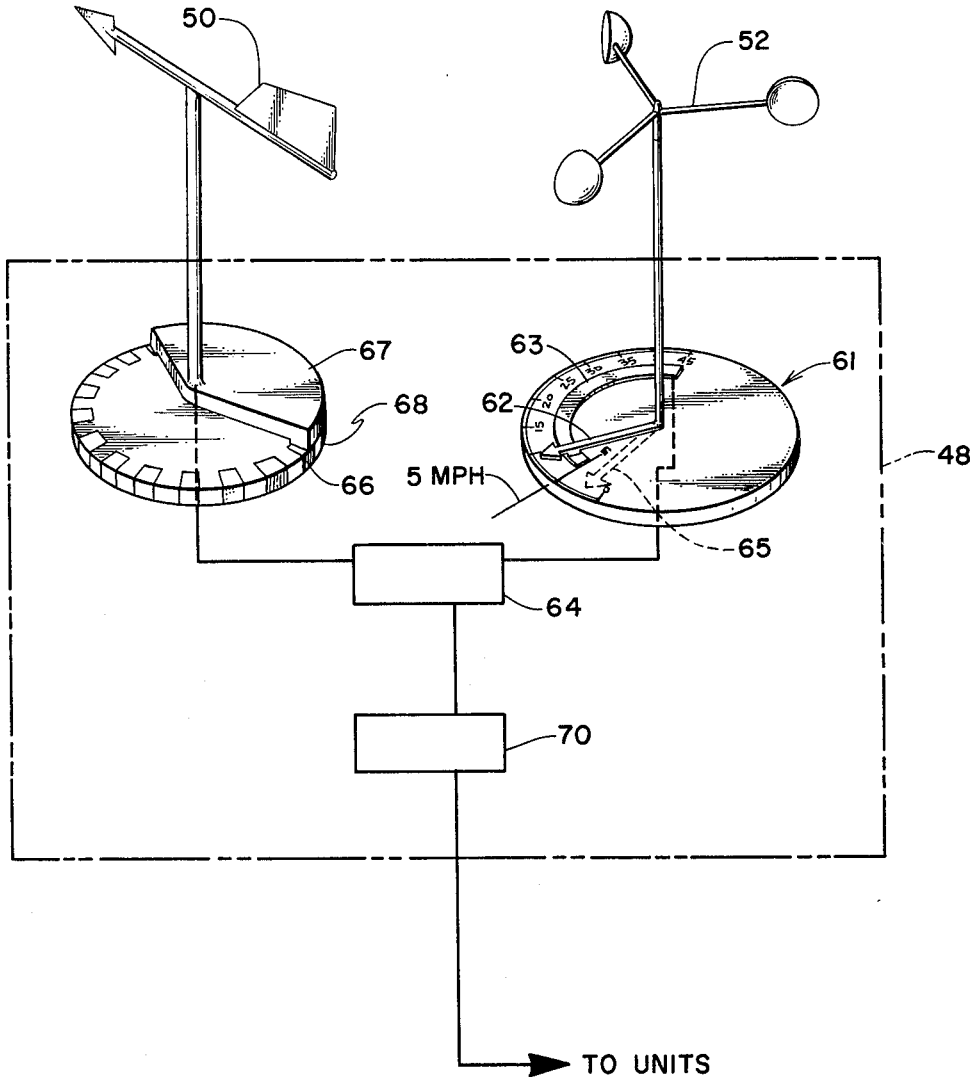
FIG. 9 is a schematic of the control assembly for the assembly in FIG. 1.

The control unit 48 receives the wind-speed and wind-direction information from transmitters 50 and 52 and activates certain units of the assembly in response thereto. The control unit 48 for the spoke-like assembly 12 is illustrated in FIG. 9. The unit 48 includes a wind-speed switch 61 for receiving the wind-speed information and activating the units of the assembly into a high-wind condition when the wind speed exceeds a predetermined level. In a high-wind condition the rotor 62 engages a contact 63, transmitting a high-wind signal to control box 64. In a low-wind condition, such as illustrated with the rotor in a ghost drawing at 65, contact 63 is not engaged and the assembly will remain in its low-wind configuration. The position of the rotor 62 is dependent upon the speed of the wind with the position of the contact 63 adjustable to select the cutoff speed desired. In the example illustrated, the position of the contact 63 is set so that the rotor 62 first establishes contact at a wind speed of five miles per hour.

The control box 64 also receives information from the wind-direction control 66. The wind-direction control 66 controls the units of the spokes in a high-wind condition, selecting which of the two trajectories each unit projects liquid drops into. The direction control 66 includes a commutator 67 and multiple contacts such as 68 and 69, each contact correlating to the units of a spoke of the assembly 12. As the commutator 67 is positioned in accordance with the direction of the ambient wind, the commutator 67 engages multiple contacts correlating to the spokes to the left side from the direction of the wind as seen in FIGS. 6 and 9. The spokes whose contacts are engaged by the commutator 67 have their units reversed, to project liquid drops in the opposite direction than if their contacts were not engaged. For example, if in the low-wind situation all units project drops in trajectories clockwise in the figure as shown in FIG. 5, in the high-wind situation the units in spokes 21, 27, etc., to the left from the direction of the wind, are reversed as shown in FIG. 6 since the commutator 66 engages the corresponding contacts such as 68. This reversal of the units, by reversing their motors such as motor 47, for the appropriate units accomplishes the result of having no units with trajectory components in opposition to the ambient wind.

The control box 64 is enabled by the receipt of the high-wind signal from the speed switch 61, to receive the trajectory signals from the direction switch 66 in the appropriate wind conditions and to reverse the motors of the appropriate units, such as motor 47. To prevent excessive motor reversals in the case of a fluctuating wind-direction condition, a conventional delay switch 70 delays any motor reversal signals for two minutes. While the particular control unit 48 illustrated is for the spoke-like assembly 12, comparable units can be readily divised for the various configurations of the assemblies. Each of these control units, such as unit 48, is conventional as seen by the Williams and Colt patents referenced above.

As an example of the operation of the control unit 48 with the spoke-like assembly 12, in a low-wind condition the rotor 65 does not engage the contact 63 and the control box 64 is thereby not enabled. In this low-wind situation all units of the assembly project liquid drops in a counterclockwise direction as shown in FIG. 5. When the ambient wind increases in speed and exceeds the minimum high-speed level, set at five miles per hour in the example, the rotor 62 engages the contact 63, sending a signal which enables the control box 64. The enabled control box 64 then emits the motor reversing signals, reversing the units correlating to the contacts, such as 68 and 69, which are engaged by the commutator 67. The delay switch 70 prevents the reversal of any units until the reversing signal has been present for two minutes, thereby diminishing the number of unnecessary reversals in a fluctuating wind condition.

While the spoke-like assembly 12 is illustrated with a control assembly 49, many of the advantages inherent in the invention are returned even without the use of the control assembly 49. For example, if the units of the spokes were projecting drops in trajectories with common horizontal circumferential directions from each spoke in a high-wind condition also, more efficient cooling would still be achieved over assemblies not using directional wind units. Particularly in those spokes projecting drops with trajectories having components collinear with the direction of the ambient wind, the created wind effects would add to the ambient wind and complement the wind surrounding the adjacent units.

Figure 4:
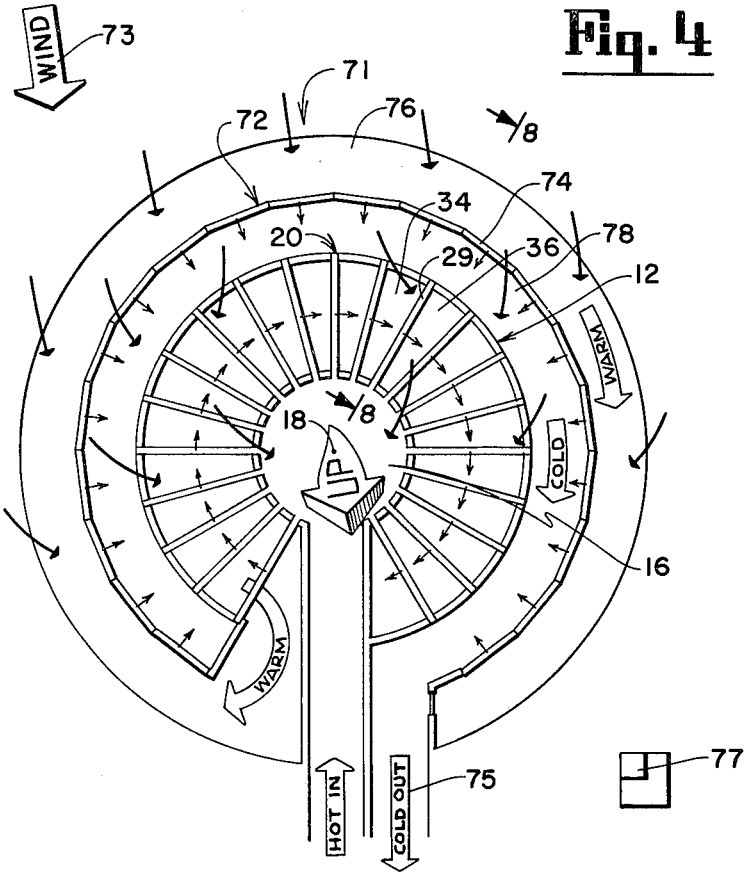
FIG. 4 is a plan view of a spoke-like liquid cooling spray assembly with concentric circular spray assembly according to the invention.

Another assembly 71 of the invention is illustrated in FIG. 4, with the spoke-like assembly 12 substantially encircled by a concentric circular spray assembly 72 comprising a plurality of liquid cooling spray units such as unit 74 with at least some units, such as unit 74, adjacent units of the spoke-like assembly 12. The units such as 74 receive the liquid to be cooled from an adjacent outer reservoir portion 76 and are adapted for selectively controlled projections of liquid drops in trajectories, each trajectory substantially extending generally perpendicular from its unit in a common horizontal direction and into an adjacent reservoir portion 78. Drop sizes, velocities and volume rates of liquid spraying are adapted to provide a directional wind effect across each unit along the common horizontal direction toward the common central point 18 of the spoke-like assembly 12.

Control means 77 similar to control means 48 controls at least some of the spray units of the concentric circular spray assembly 72 independently of the spray units of the spoke-like assembly 12 in response to the ambient wind conditions. The spoke-like spray assembly 12 is controlled in the same manner as that of FIGS. 5 and 6. In a low-wind condition, the units in the spokes such as spoke 20 project drops in trajectories with common horizontal circumferential directions from each spoke, forming a circular spray pattern about the common central point 18. In a high-wind condition only those spray units of the spokes are activated which provide a directional wind effect not in opposition to the direction of the ambient wind. The units of the circular spray assembly 72 differ somewhat from the units in the spoke-like assembly 12 in that the units in the circular assembly 72 can project only in trajectories with common horizontal direction to one side of the units toward the common central point 18. In a low-wind condition all units in the assembly 72 are activated to project toward the common point 18, as illustrated in FIG. 4 with the wind direction shown by arrow 73. In a high-wind condition, the assembly 72 can be controlled to activate only those spray units which provide a directional wind effect not in opposition to the direction of the ambient wind.

In the assembly 71 of FIG. 4, the spoke-like assembly 12 constitutes the first stage of the cooling assembly by receiving and initially cooling the hot liquid by controlled projection of liquid drops into first and second reservoir portions 34 and 36 adjacent each spoke. As seen in the cross-sectional view in FIG. 8, all first and second reservoir portions of all the spokes are interconnected between the spokes of the spray assembly 12 for receiving the initially cooled liquid (the "warm" liquid) from the units of the assembly 12. The spokes of the assembly 12 are provided with the hot water to be cooled by inner reservoir portion 16, termed the third reservoir portion.

Figure 8:
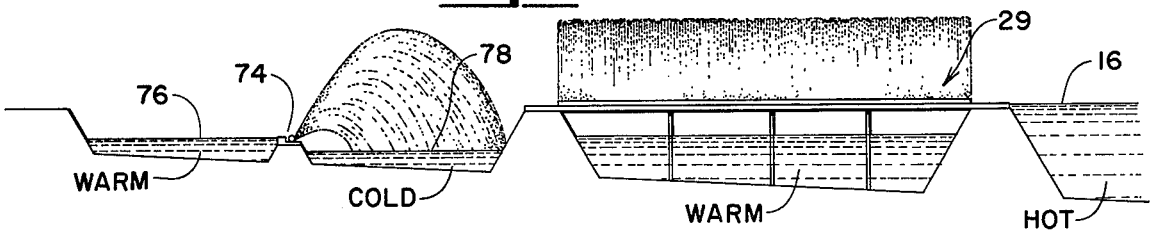
FIG. 8 is a sectional view taken along the line 8—8 of a section of the assembly in FIG. 4.

After the initial cooling of the water in the first stage 12, the water is further cooled in the circular spray assembly 72, termed the second stage in the assembly. The units of the second stage 72 further cool the warm liquid by controlled projection of liquid drops into reservoir portions 78, termed the fourth reservoir portion, adjacent the circular spray assembly. This further cooled liquid is termed "cold" liquid as shown in FIG. 8. The outer reservoir portion 76 is connected to all the first 34 and second 36 interconnected reservoir portions and substantially encircles the circular spray assembly 72 for providing the assembly 72 with the warm liquid to be further cooled. This outer reservoir portion 76 is termed the fifth reservoir portion.

As stated above, the directional wind effects produced by units of the second stage 72 blow toward the central point 18 of the spoke-like assembly 12, across the first stage 12. These directional wind effects affect the directional wind effects produced by units of the spoke-like first stage 12. Specifically, in a low-wind condition the inward directional wind effects from the second stage 72 carry to the units of the first stage and tend to highten the circular wind effect created by the first stage 12. In a high-wind condition the inward directional wind effects produced by the second stage 72 combine with the ambient wind and the directional wind effects produced by the first stage 12 to result in the overall chimney effect as illustrated in FIG. 4. In both the high and low-wind conditions, the directional wind effects produced by the second stage 72 carry to the adjacent units of the first stage 71 and affect resultant wind surrounding the first stage 12. In this sense the wind effects created across the units of the second stage 72 are complementary to the wind effects across the adjacent units of the first stage 12.

In the operation of the assembly 71, the hot liquid to be cooled enters into the third reservoir 16 and is distributed to the spokes of the first stage 12 along channels such as channel 29. The spokes of the first stage 12 initially cool the liquid by projecting it into the first and second reservoir portions, such as 34 and 36, in accordance with the invention. The "warm" liquid then flows into the fifth reservoir portion 76, and is distributed to the second stage 72 for further cooling. The second stage 72 further cools the liquid by projecting it into the fourth reservoir portion 78, where the "cold" liquid is collected and carried out via an output channel 75.

It has been discovered that greater efficiency is achieved by initially cooling the hot liquid in the first stage 12 and further cooling the warm liquid in the second stage 72, rather than vice versa. Since the air flowing over the second stage 72 is heated somewhat by its liquid being projected and cooled, prior to flowing over the first stage 12, the requisite temperature differential between the liquid and the cooling air flowing over each stage is thereby maintained for maximum heat-transfer efficiency.

In a manner similar to the above discussion regarding the operation of the spoke-like assembly 12 per se, of FIG. 1, this combination of the spoke-like assembly 12 with concentric circular assembly 72 can also be operated without a control unit 48. Some loss in cooling efficiency is suffered in such a case, since the assembly 71 would not automatically switch between its low and high-wind conditions. However, some increase in cooling efficiency is obtained over assemblies which do not utilize the liquid spray units.

Figure 2:
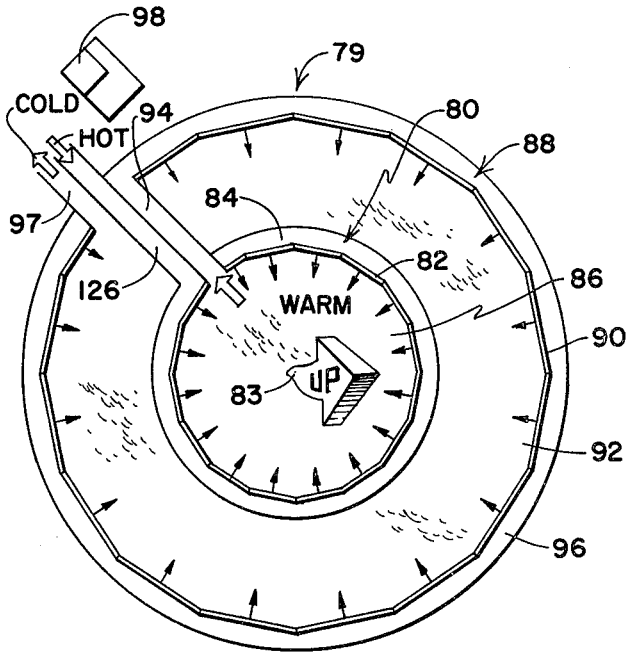
FIG. 2 is a plan view of a liquid cooling spray assembly with two circular stages according to the invention.

Another embodiment of the invention is illustrated in FIG. 2 wherein a large-scale liquid cooling assembly 79 has a first stage 80 with a plurality of liquid spray units, such as unit 82, aligned in a circular form about a central common point 83 to receive hot liquid to be cooled from a reservoir portion 84, and to initially cool the hot liquid by controlled projections of liquid drops into an inner reservoir portion 86 adjacent the units of the first stage. The units, such as unit 82, create directional wind effects by controlled projection of the liquid drops in trajectories substantially extending generally perpendicular from its unit toward the central common point 83 of the assembly creating directional wind effects across the units of the first stage and toward the central common point 83.

A second stage 88 of the assembly has a plurality of the same type liquid spray units, such as unit 90, aligned in a circular form substantially encompassing the first stage 80, with at least some units adjacent units of the first stage 80. The units of the second stage 88 receive the warm liquid initially cooled by the first stage 80 and further cool the liquid by similarly projecting liquid drops into a reservoir portion 92 adjacent the units of the second stage, creating directional wind effects across the units of the second stage toward the central point 83. The second stage 88 receives the warm liquid initially cooled by the first stage 80 by means of a channel 94 interconnecting the reservoir portion 86 receiving the warm liquid with a reservoir portion 96 supplying the liquid to units of the second stage 88. The cold liquid is removed from the reservoir portion 92 by means of output channel 97.

The units of both the first stage 80 and the second stage 88 can only project drops in trajectories toward the center 83 of the assembly. Control means 98 similar to control means 48 discussed above can be included to selectively control the units of both stages. In a low-wind condition, all units of all stages can be running, wherein the wind effects from the second stage 88 carry to the first stage 80 and reinforce its wind effects, thereby creating a reinforced chimney effect above the reservoir 86 by the combination of the resulting winds meeting above the central point 83. In the sense that the wind effects produced by the units of the two stages are collinear and reinforcing, the wind effects are complementary. In a high-wind situation, the assembly 79 can be controlled to activate only those units in both the stages which provide a directional wind effect not in opposition to the direction of the ambient wind. For example, if the ambient wind in a high-wind condition were entering onto the assembly 79 along the direction of the output channel 97, all units of both stages, such as units 82 and 90, which produced an overall directional wind effect with components opposing the ambient wind could be turned off. The left on would then reinforce the ambient wind and its attendant cooling effect. As in the assembly configurations discussed above, it is possible to leave all units running in even a high-wind condition, although with some resulting loss in cooling efficiency.

In the assembly 79 illustrated, the first stage 80 initially cools the hot liquid with the second stage 88 subsequently further cooling the liquid. In this situation the cool ambient wind generally cools the warm liquid sprayed by the units of the second stage 88 prior to cooling the hot liquid sprayed by the units of the first stage 80. As discussed above, this sequence increases the cooling efficiency of the assembly 79 in that the requisite temperature gradient is better maintained than if the cool ambient wind were first to cool the hot liquid, with the warmer ambient wind subsequently cooling the warm liquid.

Figure 3:
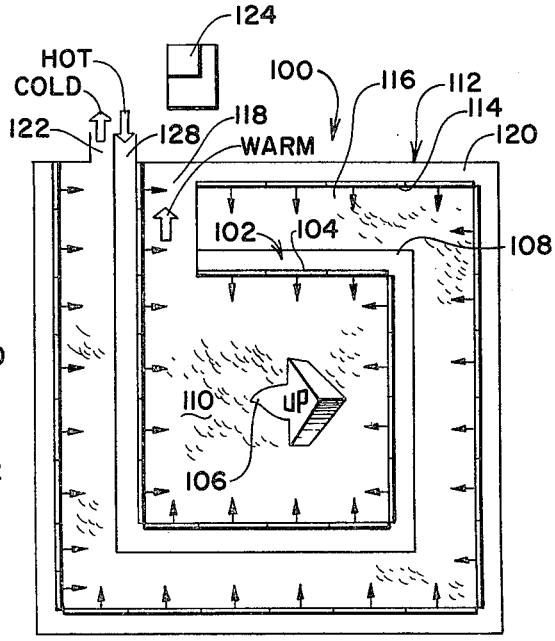
FIG. 3 is a plan view of a liquid cooling spray assembly with two rectangular stages according to the invention.

Assembly 100, illustrated in FIG. 3, forms another embodiment of the invention similar in many respects to the embodiment of assembly 79. A first stage 102 has a plurality of liquid spray units, such as unit 104, aligned in rectangular form about a common central point 106 to receive hot liquid to be cooled from a reservoir portion 108, and to initially cool the hot liquid by controlled projections of liquid drops into an inner reservoir portion 110 adjacent the units of the first stage 102. The units, such as unit 104, create directional wind effects by controlled projection of the liquid drops in trajectories substantially extending generally perpendicular from its unit toward the common central point 106, creating directional wind effects across the units of the first stage and toward the common central point 106.

A second stage 112 of the assembly has a plurality of the same type liquid spray units, such as unit 114, aligned in a rectangular form substantially encompassing the first stage 102 with at least some units adjacent units of the first stage. The units of the second stage 112 receive the warm liquid initially cooled by the first stage 102 and further cool the liquid by similarly projecting liquid drops into a reservoir portion 116 adjacent the units of the second stage, creating directional wind effects acress the units of the second stage toward the central point 106. The second stage 112 received the warm liquid initially cooled by the first stage 102 by means of a channel 118 interconnecting the reservoir portion 110 receiving the warm liquid with a reservoir portion 120 supplying the liquid to the units of the second stage. The cold liquid is removed from the reservoir portion 116 by means of an output channel 122.

The units of the second stage 112 can only project drops into trajectories toward the center 106 of the assembly. Control means 124 similar to control means 48 discussed above can be included to selectively control the units of both stages. In a low-wind condition all the units of all stages can be running, wherein the wind effects from the second stage 112 carry to the first stage and reinforce its wind effects, thereby creating a reinforced chimney effect above the reservoir portion 110 by the combination of the resulting winds meeting above the central point 106. In the sense that the wind effects produced by the units of the two stages are collinear and reinforcing, the wind effects are complementary. In a high-wind situation, the assembly 100 can be controlled to activate only those units in both the stages which provide a directional wind effect not in opposition to the direction of the ambient wind. For example, if the ambient wind in a high-wind condition were entering onto the assembly 100 along the direction of the output channel 122, all units of both stages which produce an overall directional wind effect components opposing the ambient wind could be turned off. The units left on would then reinforce the ambient wind and its resulting cooling affect. As in the assembly configuration discussed above, it is possible to leave all units running in even a high-wind condition, although with some resulting loss in cooling efficiency.

In the same manner as discussed in regard to assembly 79, assembly 100 has the first stage 102 initially cooling the hot liquid with the second stage 112 subsequently further cooling the liquid. For reasons discussed in regard to assembly 79, this obtains the maximum cooling efficiency for the assembly.

The operation of both the circular cooling assembly 79 and the rectangular cooling assembly 100 are similar. In the circular assembly 79, hot liquid is carried into reservoir portion 84 by channel 126 and is initially cooled by the first stage 80 by projecting hot liquid drops into the inner reservoir portion 86. The resulting warm liquid is carried via channel 94 to reservoir portion 96 where it is supplied to the second stage 88 and further cooled by projection of drops into reservoir portion 92. The resulting cold liquid is removed from the assembly via channel 97. In the rectangular assembly 100, hot liquid is carried into reservoir portion 108 by channel 128 and is initially cooled by the first stage 102 by projecting hot liquid drops into the inner reservoir portion 110. The resulting warm liquid is carried via channel 118 to reservoir portion 120 where it is supplied to the second stage 112 and further cooled by projection of drops into reservoir portion 116. The resulting cold liquid is removed from the assembly via channel 122.

Modifications of the various large-scale cooling assemblies will be evident under the principles of the invention. For example, a rectangular second stage such as second stage 112 of assembly 100 could readily replace the concentric circular second stage 88 of assembly 79 or concentric circular second stage 72 of assembly 71. Similarly a concentric circular second stage such as second stage 88 of assembly 79 could replace the rectangular second stage 112 of assembly 100. As discussed above, several different types of units for projecting liquid drops to cool the liquid and create directional wind effects exist and could be substituted for the bi-directional units such as unit 30, or for the uni-directional units such as unit 82. Or units producing varied directional wind effects could be operated within an assembly, such as illustrated in FIG. 1, although maximum cooling efficiency may not be achieved in such a configuration.

In any of the illustrated configurations or in any of the obvious modifications discussed above, the ambient wind speed in which each assembly should be switched between a low-wind and a high-wind configuration is dependent upon a number of variables. For example, the temperature of the ambient air, the temperature of the "hot" to be cooled, and the actual number and configuration of wind spraying units employed may all effect the cutoff wind speed for obtaining maximum cooling capability. It is felt, however, that a cutoff speed between three and eight miles per hour should provide for most of the cases.

According to the foregoing specification, the nature and background of this invention have been set forth and some of the ways of practicing the invention have been described, including the preferred embodiments presently contemplated at the best modes of carrying out the invention.

I claim:

1. A large scale cooling assembly having first and second stages for air cooling of hot liquid wherein each of such stages has a plurality of liquid spray units adapted for selective controlled projection of liquid drops under variable ambient wind conditions in at least one trajectory, the trajectory substantially extending generally perpendicular from its unit and in a common horizontal direction therefrom with drop sizes, velocities and volume rates of liquid spraying adapted to provide a directional wind effect across the unit along the common horizontal direction;

the first stage is aligned and oriented to receive and initially cool the hot liquid by the controlled projection of liquid drops into a reservoir portion adjacent the units of the first stage, creating a generally horizontal directional wind effect across the units of the first stage;

the second stage has at least some units adjacent units of the first stage and is aligned and oriented to receive and cool the liquid by the controlled projection of liquid drops into a reservoir portion adjacent the units of the second stage, creating a generally horizontal directional wind effect across the units of the second stage complementary to the directional wind effect across the adjacent units of the first stage; and the second stage is aligned and oriented to receive and further cool the liquid initially cooled by the first stage.

2. A large scale cooling assembly according to claim 1 wherein the first stage has its plurality of liquid spray units aligned in a rectangular form;

the second stage has its plurality of liquid spray units aligned in a rectangular form; and one of the first and second stages is wholly encompassed by the other stage.

3. A large scale liquid cooling assembly according to claim 2 wherein the large scale liquid cooling assembly includes a control means for controlling at least some of the spray units of the first and second stages independently of at least some of the other spray units to provide for optional selection or directional wind effects for the spray units in accordance with ambient wind conditions, responding to an ambient wind condition of greater than a predetermined velocity by activating only those spray units which provide a directional wind effect not in opposition to the direction of the ambient wind.

4. A large scale cooling assembly according to claim 1 wherein the first stage has its plurality of liquid spray units aligned in a circular form;

the second stage has its plurality of liquid spray units aligned in a circular form; and one of the first and second stages is wholly encompassed by the other stage.

5. A large scale liquid cooling assembly according to claim 4 wherein the large scale liquid cooling assembly includes a control means for controlling at least some of the spray units of the first and second stages independently of at least some of the other spray units to provide for optional selection of directional wind effects for the spray units in accordance with ambient wind conditions, responding to an ambient wind condition of greater than a predetermined velocity by activating only those spray units which provide a directional wind effect not in opposition to the direction of the ambient wind.

6. A large scale liquid cooling assembly having first and second stages for air cooling of hot liquid wherein each of such stages has a plurality of liquid spray units adapted for selective controlled projection of liquid drops under variable ambient wind conditions in at least one trajectory, the trajectory substantially extending generally perpendicular from its unit and in a common horizontal direction therefrom with drop sizes, velocities and volume rates of liquid spraying adapted to provide a directional wind effect across the unit along the common horizontal direction;

the first stage is aligned and oriented to receive and initially cool the hot liquid by the controlled projection of liquid drops into a reservoir portion adjacent the units of the first stage, creating a generally horizontal directional wind effect across the units of the first stage;

the first stage further has its plurality of liquid spray units aligned in a spoke-like spray assembly comprising a plurality of rows of liquid cooling spray units arranged as diverging spokes extending radially in a plurality of different horizontal directions from a common central point; each of which spokes has a plurality of liquid spray units adapted for selective controlled projection of liquid drops in at least one trajectory into a reservoir portion adjacent the spoke, each trajectory substantially extending generally perpendicular from its spoke and in a common horizontal direction therefrom;

the second stage has at least some units adjacent units of the first stage and is aligned and oriented to receive and cool the liquid by the controlled projection of liquid drops into a reservoir portion adjacent the units of the second stage, creating a generally horizontal directional wind effect across the units of the second stage complementary to the directional wind effect across the adjacent units of the first stage; and the second stage further has its plurality of spray units aligned in a concentric circular spray unit assembly arranged to substantially encircle the spoke-like spray assembly.

7. A large scale liquid cooling assembly according to claim 6 wherein each spoke of the first stage has a plurality of liquid spray units adapted for selective controlled projection of liquid drops in one of two first and second trajectories, each trajectory substantially extending generally perpendicular from its spoke and in a common horizontal direction therefrom with drop sizes, velocities and volume rates of liquid spraying adapted to provide a directional wind effect across the spoke along the common horizontal direction; each of which spokes is aligned and oriented to selectively project liquid drops in the first trajectory into the reservoir portion adjacent the unit on one side of the unit, and to selectively project liquid drops in the second trajectory into the reservoir portion adjacent the unit on the other side of the unit;

the second stage concentric spray unit assembly is aligned and oriented to receive and further cool the liquid initially cooled by the first stage; and the large scale liquid cooling assembly includes a control means for controlling at least some of the spray units of the stages, including selection on one of the first and second trajectory projections for units of the spokes of the first stage.

8. A large scale liquid cooling assembly according to claim 7 wherein the control means is responsive to the ambient wind conditions in selection of the trajectory projections for the spray units, and controls at least some of the spray units of the concentric spray assembly independently of the spray units of the spoke-like spray assembly.

9. A large scale liquid cooling assembly having first and second stages for air cooling of hot liquid wherein each of such stages has a plurality of liquid spray units adapted for selective controlled projection of liquid drops under variable ambient wind conditions in at least one trajectory, the trajectory substantially extending generally perpendicular from its unit and in a common horizontal direction therefrom with drop sizes, velocities and volume rates of liquid spraying adapted to provide a directional wind effect across the unit along the common horizontal direction;

the first stage is aligned and oriented to receive and initially cool the hot liquid by the controlled projection of liquid drops into a reservoir portion adjacent the units of the first stage, creating a generally horizontal directional wind effect across the units of the first stage;

the second stage has at least some units adjacent units of the first stage and is aligned and oriented to receive and cool the liquid by the controlled projection of liquid drops into a reservoir portion adjacent the units of the second stage, creating a generally horizontal directional wind effect across the units of the second stage complementary to the directional wind effect across the adjacent units of the first stage;

the liquid cooling assembly further has its liquid spray units aligned in a spoke-like spray assembly comprising a plurality of rows of liquid cooling spray units arranged as diverging spokes extending radially in a plurality of different horizontal directions from a common central point; each of which spokes has a plurality of liquid spray units adapted for selective controlled projection of liquid drops in at least one trajectory into a reservoir portion adjacent the spoke, each trajectory substantially extending generally perpendicular from its spoke and in a common horizontal direction therefrom;

the first stage comprises the liquid cooling spray units arranged as one of the diverging spokes;

and the second stage comprises the liquid cooling spray units arranged as another of the diverging spokes.

10. A large scale liquid cooling assembly according to claim 9 wherein each spoke of the first and second stage of the cooling assembly has a plurality of liquid spray units adapted for selective controlled projection of liquid drops in one of two first and second trajectories, each trajectory substantially extending generally perpendicular from its spoke and in a common horizontal direction therefrom with drop sizes, velocities and volume rates of liquid spraying adapted to provide a directional wind effect across the spoke along the common horizontal direction, each of which spokes is aligned and oriented to selectively project liquid drops in the first trajectory into the reservoir portion adjacent the unit on one side of the unit, and to selectively project liquid drops in the second trajectory into the reservoir portion adjacent the unit on the other side of the unit; and the large scale liquid cooling assembly includes a control means for controlling at least some of the spray units of the spokes of the first and second stages, including selection of one of the first and second trajectory projections for units of the spokes of the first and second stages.

11. A large scale liquid cooling assembly according to claim 10 wherein the spray units project liquid drops in trajectories with common horizontal circumferential directions from each spoke, forming a circular spray pattern about the central common point and thereby inducing a circular wind effect about the common central point by which heated air resulting from evaporative cooling of the projected liquid drops in forced vertically upward in a whirling motion.

12. A large scale liquid cooling assembly having a spoke-like spray assembly comprising a plurality of rows of liquid cooling spray units arranged as diverging spokes extending radially in a plurality of different horizontal directions from a common central point;

each of which spokes has a plurality of liquid spray units adapted for selective controlled projection of liquid drops in one of two first and second trajectories, each trajectory substantially extending generally perpendicular from its spoke and in a common horizontal direction therefrom with drop sizes, velocities and volume rates of liquid spraying adapted to provide a directional wind effect across the spoke along the common horizontal direction;

each of which spokes in aligned and oriented to selectively project liquid drops in the first trajectory into a first reservoir portion adjacent the unit on one side of the unit, and to selectively project liquid drops in the second trajectory into a second reservoir portion adjacent the unit on the other side of the unit; and control means for controlling the spray units of at least some rows independently of the spray units of other rows including selection of one of the first and second trajectory projections for units of at least some rows.

13. A liquid cooling assembly according to claim 12 wherein the control means respond to the ambient wind conditions in selection of the trajectory projections for the spray units.

14. A liquid cooling assembly according to claim 12 wherein the spray units project liquid drops in trajectories with common horizontal circumferential directions from each spoke, forming a circular spray pattern about the common central point and thereby inducing a circular wind effect about the common central point by which heated air resulting from evaporative cooling of the projected liquid drops is forced vertically upward in a whirling motion.

15. A liquid cooling assembly according to claim 14 having a third reservoir portion connected to the spoke-like spray assembly for providing the units of the spoke-like spray assembly with water to be cooled; and having the first and second reservoir portions interconnected between the spokes of the spoke-like spray assembly for receiving the water from the liquid spray units.

16. A liquid cooling assembly according to claim 12 having a concentric circular spray unit assembly comprising a plurality of liquid cooling spray units arranged to substantially encircle the spoke-like spray assembly;

each spray unit of the concentric circular spray unit assembly is adapted for selectively controlled projection of liquid drops in a trajectory, each trajectory substantially extending generally perpendicular from its unit in a common horizontal direction, with drop sizes, velocities and volume rates of liquid spraying adapted to provide a directional wind effect across the unit along the common horizontal direction; and each spray member of the concentric circular spray unit assembly is aligned and oriented to selectively project liquid drops in a horizontal direction into a fourth reservoir portion adjacent the outer spray unit assembly.

17. A liquid cooling assembly according to claim 16 having a third reservoir portion connected to the spoke-like spray assembly for providing the units of the spoke-like spray assembly with water to be cooled; having the first and second reservoir portions interconnected between the spokes of the spoke-like spray assembly for receiving the water from the liquid spray members of the spoke-like assembly; and having a fifth reservoir portion connected to the first and second interconnected reservoir portions and substantially encircling the spoke-like spray assembly for providing the units of the concentric circular spray assembly with water to be cooled.

18. A liquid cooling assembly according to claim 17 wherein the control means controls at least some of the spray units of the concentric circular spray assembly independently of the spray units of the spoke-like spray assembly.

19. A liquid cooling assembly according to claim 18 wherein the control means is responsive to the ambient wind conditions in selection of the trajectory projections for the spray units.

* * * * *

UNITED STATES PATENT OFFICE
CERTIFICATE OF CORRECTION

PATENT NO. : 3,966,859

DATED : June 29, 1976

INVENTOR(S) : Leonard J. Boler

It is certified that error appears in the above-identified patent and that said Letters Patent are hereby corrected as shown below:

Column 8, line 68, "divised" should be --devised--. Column 9, line 56, insert --spray-- after "spoke-like". Column 11, line 65, insert --portion-- after "reservoir". Column 12, line 10, insert --units-- after "The"; line 32, insert --a-- after "in"; line 53, "acress" should read --across--; Column 14, line 2, insert --water-- after "hot"; line 12, "at" should read --as--. Column 16, line 15, "on" should read --of--. Column 17, line 37, "in" should read --is--; line 53, "in" should read --is--.

Signed and Sealed this

Fourth Day of January 1977

[SEAL]

*Attest:*

RUTH C. MASON
*Attesting Officer*

C. MARSHALL DANN
*Commissioner of Patents and Trademarks*